United States Patent [19]

Aoshima et al.

[11] Patent Number: 5,007,281

[45] Date of Patent: Apr. 16, 1991

[54] PLASTIC WORKING METHOD AND APPARATUS

[75] Inventors: Syozo Aoshima, Nagoya; Kunio Hirota, Aichi; Hiroshi Sakakibara; Naoyuki Sawai, both of Nagoya; Takeaki Sato, Kasugai, all of Japan

[73] Assignee: Brother Kogyo Kabushiki Kaisha, Aichi, Japan

[21] Appl. No.: 513,624

[22] Filed: Apr. 24, 1990

Related U.S. Application Data

[62] Division of Ser. No. 227,301, Aug. 2, 1988, Pat. No. 4,936,125.

[30] Foreign Application Priority Data

Aug. 8, 1987 [JP] Japan ..... 62-198847
Aug. 8, 1987 [JP] Japan ..... 62-198848

[51] Int. Cl.[5] ..... B21J 9/02
[52] U.S. Cl. ..... 72/406; 72/67
[58] Field of Search ..... 72/67, 406, 112, 115, 72/74

[56] References Cited

U.S. PATENT DOCUMENTS

| | | | |
|---|---|---|---|
| 3,583,192 | 6/1971 | Kocks . | |
| 3,990,285 | 11/1976 | Dragoun | 72/67 |
| 3,990,286 | 11/1976 | Cremonesi . | |
| 4,069,698 | 1/1978 | Dragoun . | |
| 4,391,121 | 7/1983 | Taruntaev . | |
| 4,698,992 | 10/1987 | Bernet | 72/67 |

FOREIGN PATENT DOCUMENTS

| | | | |
|---|---|---|---|
| 238186 | 9/1987 | European Pat. Off. . | |
| 3510250 | 10/1985 | Fed. Rep. of Germany . | |
| 3539924 | 5/1987 | Fed. Rep. of Germany . | |
| 60-227939 | 11/1985 | Japan . | |
| 517514 | 6/1976 | U.S.S.R. . | |
| 608590 | 5/1978 | U.S.S.R. . | |
| 721187 | 3/1980 | U.S.S.R. | 72/406 |
| 9041003 | 7/1982 | U.S.S.R. . | |
| 1061905 | 12/1983 | U.S.S.R. . | |
| 1117228 | 10/1984 | U.S.S.R. | 72/67 |
| 1315085 | 6/1987 | U.S.S.R. | 72/67 |
| 319065 | 3/1929 | United Kingdom . | |
| 1205171 | 9/1970 | United Kingdom . | |
| 1224259 | 3/1971 | United Kingdom . | |
| 1224260 | 3/1971 | United Kingdom . | |

*Primary Examiner*—Daniel C. Crane
*Attorney, Agent, or Firm*—Oliff & Berridge

[57] ABSTRACT

Plastic working method and apparatus are disclosed. The plastic work such as forging is carried out by partial pressing contact of a die with a partial portion of a workpiece. The die is moved in a swinging or circular rocking fashion. The plastic working apparatus comprises a lower die for supporting the workpiece; an upper die swingably provided in a swinging plane about a predetermined position for relatively depressing the workpiece with respect to the lower die in accordance with the swing motion and for performing the plastic work to the workpiece in cooperation with the lower die; and a moving mechanism for relatively moving the workpiece and the upper die within the swing plane during the working operation. A plastic working method comprises the steps of; swinging at predetermined amplitudes the die arranged in confronted relations with the workpiece; and, relatively moving a center of the swing amplitudes of the die relative to the workpiece within its swinging plane, thereby performing the plastic work in response to a shape of a molding die portion of said die.

3 Claims, 11 Drawing Sheets

PLASTIC WORKING METHOD AND APPARATUS

This is a division of application Ser. No. 07/227,301 filed Aug. 2, 1988, now U.S. Pat. No. 4,936,125.

BACKGROUND OF THE INVENTION

This invention relates to a plastic working method and its apparatus.

Forging is a typical method for plastic working. However, ordinary forging requires an extremely large load, since an entire active surface of a shaping tool (die) is in surface pressure contact with an overall surface of the workpiece. In order to avoid this deficiency, rotational forging has been developed since it requires a relatively small load for shaping the workpiece. According to the rotational forging, a part of the active surface of the shaping tool is in pressure contact with a part of the surface of the workpiece, and such partial forging is repeatedly applied to the workpiece, so that entire surface of the workpiece undergoes forging.

A conventional apparatus for plastic working such as coining or sizing has an upper die and a lower die. A workpiece is mounted on the lower die and is depressed between the upper and lower dies. The upper die is movable up and down with respect to the lower die along a predetermined axis or is swung (two dimensional swinging motion) about a single point on the workpiece by means of the operation of an eccentric cam, a crank, a screw mechanism or a toggle mechanism.

According to another type of a prior art plastic working apparatus, a die is swivelled (three dimensional motion) at a predetermined slant angle with respect to an axis passing through a predetermined position of a workpiece, and in accordance with the swivelling motion, the plastic work is applied to the workpiece in comformance with the shape of a shaping die portion of the die. In this type, one of the dies, such as an upper die, is adapted to perform a circular rocking motion relative to the other die (lower die).

However, according to the conventional apparatus, since the load center of the upper die relative to the workpiece is always kept constant, the plastic flow of the workpiece material is restrained. It is therefore difficult to perform the plastic working with high accuracy.

Further, according to another type of the conventional apparatus, since the swivelling center of the die is always kept constant, it is impossible to increase an "expansion amount" of the workpiece material, and excellent swaging may not be attainable. In other words, plasticized metal flow is not sufficiently reached into the finely configured portion of the workpiece so as to manufacture a product having a complicated outer shape. Thus, it would be difficult to perform the work with high precision. In addition, it would be impossible to apply the working operation to a complicated work since the operational mode is limited in such prior art apparatus.

Such conventional forging apparatus are described in, for example, U.S. Pat. No. 3,990,285, and G. B. Patent Nos. 319,065, 1,205,171, 1,224,259 and 1,225,260.

SUMMARY OF THE INVENTION

Accordingly, in order to overcome the above-noted defect, an object of the invention is to provide a plastic working method and its apparatus in which the load center relative to the workpiece is changeable during the working operation, to thereby accelerate the plastic flow of the material, so that the working precision is enhanced.

Another object of the invention is to provide a plastic working method and apparatus which is capable of enhancing fluidity of a plasticized metal to thereby perform the precision work with a high accuracy.

Still another object of this invention is to provide such method and apparatus capable of providing various operational modes by changing the swinging or swivelling center of the die to thus manufacture a product having intricate an external shape.

These and other objects of this invention will be attained by providing a plastic working apparatus which includes a first die having a shaping face, a second die confronting the first die for mounting thereon a workpiece, the workpiece being depressed by co-operation of the first and second dies, and moving means connected to the first die for moving the first die to repeatedly change orientation of said shaping face relative to the workpiece. Importantly, the feature of this invention resides in the moving means which comprises a first moving means for providing one of swinging motion and circular rocking motion of the first die, in the swinging motion a swinging center line being defined, and in the circular rocking motion a swivelling center line being defined; and, a second moving means for displacing one of the swinging center line and the swivelling center line relative to the workpiece.

In another aspect, according to this invention there is provided a method for plastic working in which a workpiece is interposed between first and second dies confronting with each other, one of the first and second dies being movable toward and away from the remaining one of the second and first dies in a first direction, and one of the first and second dies performing one of swinging motion and circular rocking or swivelling motion providing one of swinging center line and swivelling center line for effecting a plastic working to said workpiece. The important feature in the method comprises the step of displacing one of the swinging center line and swivelling center line during said plastic working.

According to a first embodiment of the present invention, there is provided a method comprising the steps of swinging at predetermined amplitudes a die arranged in confronted relation with a workpiece, and relatively moving a center of the swing amplitudes of the die relative to the workpiece within its swinging plane, thereby performing the plastic work in response to an inner shape of a molding die portion of the die.

In order to perform this method, there is provided an apparatus comprising a lower die for supporting a workpiece, an upper die swingably provided about a predetermined position for relatively depressing the workpiece with respect to the lower die in accordance with the swing motion and for performing the plastic work to the workpiece in cooperation with the lower die, and moving means for relatively moving the workpiece and the upper die within the swing plane during the working operation.

With the structure and method thus organized, under the condition that the workpiece is supported to the lower die, the upper die is swung at a predetermined amplitude about a predetermined position, and in accordance with the swing motion, the workpiece is depressed against the lower die. At the same time, the workpiece and the upper die are relatively moved in the swing plane of the upper die during the working operation by the moving means, thereby relatively moving the center of the swing amplitude of the upper die to perform the plastic work in response to an inner shape of the upper die.

According to another embodiment of this invention, there is provided a plastic working method characterized by comprising the steps of: swivelling a die at a predetermined slant angle with respect to an axis passing through a predetermined position of a workpiece about the predetermined position of the workpiece, and moving at least one of the die and the workpiece within a predetermined range on a plane substantially intersecting with the axis, thereby performing the plastic work in response to a shape of a molding die portion of the die.

In order to perform this method, there is provided a plastic working apparatus characterized by comprising a rotary shaft rotatably supported about one axis; a workpiece support surface formed in confronted relation with an end portion of the rotary shaft and substantially intersecting with the axis, a holder rotatably connected at its proximal end to the end of the rotary shaft at a position eccentric with respect to the rotary axis of the rotary shaft, and extending toward a workpiece on the workpiece support surface at a predetermined slant angle with respect to the axis, the holder having a die mount portion at its distal end, eccentric rotary bodies having an eccentric hole engaging with an outer periphery of the die mounting portion of the holder, and moving the die mounting portion within a predetermined range in accordance with the rotation of the eccentric hole, and a die mounted on the die mounting portion of the holder for performing the plastic work to the workpiece, wherein under the condition that the eccentric rotary bodies be rotated or stopped, the rotary shaft is rotated so that the die is swivelled about the axis of the rotary shaft.

According to this embodiment, the workpiece is arranged on the workpiece support surface, and under the condition that the eccentric rotary bodies be stopped or rotated, the rotary shaft is rotated. As a result, the die is swivelled about the axis of the rotary shaft together with the holder to perform the plastic work by means of the die. That is, an initial position of one end of the holder is provided at a controlled offsetting position with respect to the rotary axis, and initial position of another end of the holder (die mount portion) is also provided at a controlled offsetting position with respect to the rotary axis. Therefore, orientation of the holder can be changeable during machining to thereby change a swivelling center line of the holder. Accordingly, the shaping face in direct contact with the workpiece or die mounting portion can provide a varierty of orientations feasible for machining with high dimensional accuracy.

BRIEF DESCRIPTION OF THE DRAWINGS

In the drawings;

FIGS. 1 to 4 show a first embodiment according to this invention, and in which;

FIG. 1 is a schematic cross-sectional view showing a plastic working apparatus;

FIGS. 2(*a*), 2(*b*) and 2(*c*) are illustrations showing various operational states of the plastic working apparatus;

FIG. 3 is a block diagram showing a control circuit of the plastic working apparatus; and, FIG. 4 is an illustration showing operational modes of upper and lower dies in the first embodiment;

FIGS. 5 and 6 show a second embodiment of the invention, and in which;

FIG. 5 is a schematic cross-sectional view; and,

FIGS. 6(*a*), 6(*b*) and 6(*c*) are illustrations showing various operational states in the second embodiment;

FIGS. 7 to 9 show a third embodiment of the invention, and in which;

FIG. 7 is a schematic cross-sectional view;

FIG. 8 is a partially enlarged view; and

FIGS. 9(*a*), 9(*b*) and 9(*c*) are illustrations showing various operational states in the third embodiment;

FIG. 10 to 13 show a fourth embodiment, and in which,

FIG. 10 is a frontal cross-sectional view showing a plastic working apparatus;

FIG. 11 is a cross-sectional view taken along the line A—A of FIG. 10;

FIG. 12 is a cross-sectional view taken along the line B—B of FIG. 10; and FIGS. 13(*a*) to 13(*f*) are illustrations showing various operational modes in the fourth embodiment.

DETAILED DESCRIPTION OF THE PREFERRED EMBODIMENTS

Figure 1:
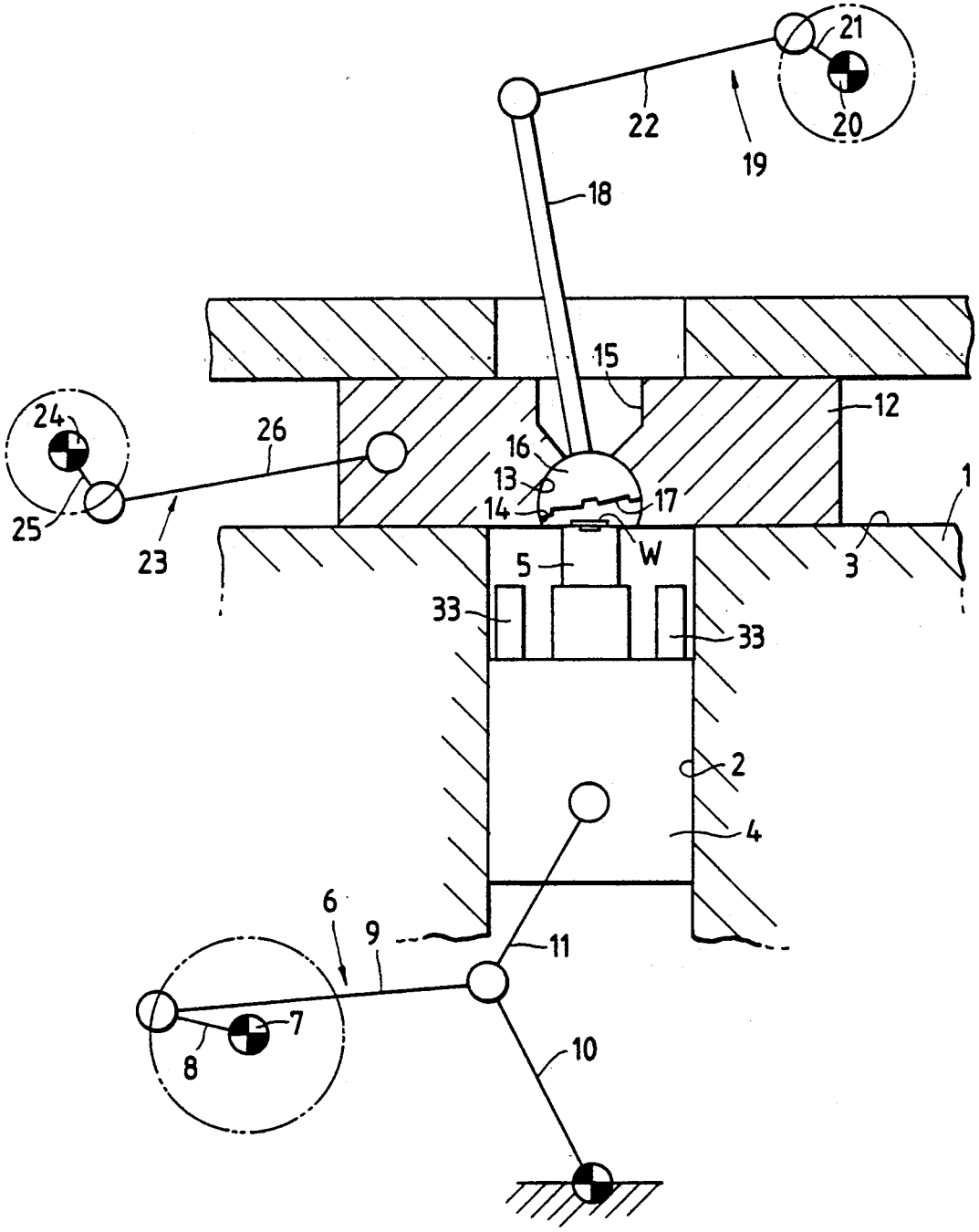
Figure 2A:
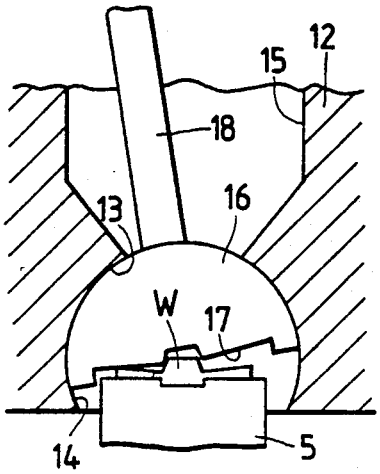
Figure 2B:
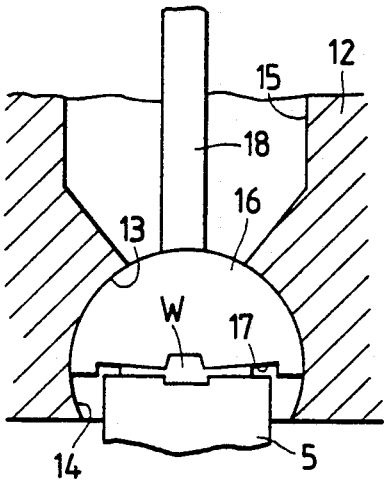
Figure 2C:
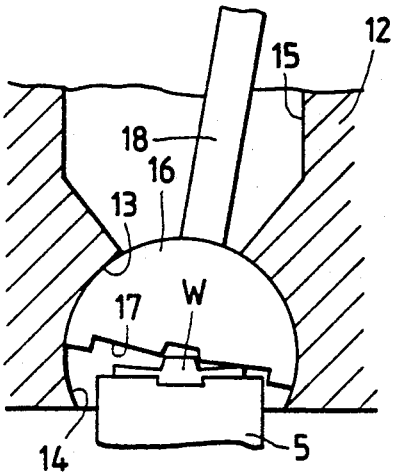

A plastic working apparatus such as a forging apparatus according to a first embodiment of this invention will now be described in detail with reference to FIGS. 1 thru 4. As shown in FIG. 1, in a base frame 1 of the apparatus, there are formed first and second guide holes 2 and 3 that intersect with each other and that extend in the vertical and horizontal directions, respectively (this vertical direction is referred to as a first direction in the claims). A lower support ram 4 is received movably up and down in the vertically extending first guide hole 2. A lower die (referred as a second die in the claims) 5 is disposed on the upper surface of the lower support ram 4 for supporting the workpiece W made of metal material. A crank mechanism (referred to as third moving means in the claims) 6 for vertically moving the lower die 5 is provided on one side of the lower die support ram 4. The crank mechanism 6 includes a drive shaft 7, and four connecting links 8, 9, 10 and 11 that are pivotally connected to each other and convert rotational motion of the drive shaft 7 into a vertical reciprocal motion of the ram 4. When the drive shaft 7 is rotated, four connecting links 8, 9, 10 and 11 are actuated, so that the lower die support ram 4 is moved up and down along the first guide hole 2.

A moving member 12 is received reciprocatingly movably in the horizontally extending second guide hole 3 (this horizontal direction is referred to as a second direction in the claims). The moving member 12 is formed with a support hole 13 having a substantially semi-circular cross-section. The support hole 13 horizontally extends in a direction perpendicular to the second guide hole 3. The support hole 13 has an opening 14 that allows the lower die 5 to enter thereinto. Further, the moving member 12 is also formed with a communication hole 15 in communication with the support hole 13. Therefore, these holes 2, 13 and 15 are in communication with each other.

A holder 18 is inserted through the communication hole 15 and the semi-circular support hole 13. The lower end of the holder 18 is provided with an upper die (referred to as a first die in the claims) 16. The upper die 16 has a cross-sectional shape identical with the semi-circular shape of the support hole 13, and is arranged to be swingable along the inner peripheral surface of the support hole 13. Also, a shaping face 17 is formed in the upper die 16 in confronted relation with the lower die 5.

An upper swinging mechanism (referred to as a first moving means in the claims) 19 is connected to the upper end of the holder 18. The upper swinging mechanism 19 includes a drive shaft 20, and connecting arms 21 and 22 the latter arm connecting to the upper end of the holder 18. In accordance with the rotation of the drive shaft 20, the upper die 16 is swung through the pair of connecting arms 21 and 22. In accordance with the swinging motion, the workpiece W is depressed against the lower die 5. Also, the swing amplitude of the upper die 16 may be adjusted by adjusting a length of one of the connecting arms (swinging amplitude control means) 21 of the upper die swinging mechanism 19.

A moving member driving mechanism 23 having substantially the same arrangement as the upper die swinging mechanism 19 is provided on one side of the moving member 12. The mechanism 23 and the moving member 12 provide a second moving means referred to in the claims. The driving mechanism 23 includes a drive shaft 24, a connecting arm 25 and a second connecting arm 26 having one end pivotally connected to the first arm 25 and another end pivotally connected to the moving member 12. The rotation of the drive shaft 24 causes the moving member 12 to reciprocatingly move through connecting arms 25 and 26. The reciprocating motion causes the relative position of the upper and lower dies 16 and 5 to change. Further, the relative positional relationship in the horizontal direction between both the dies 16 and 5 may be adjusted by adjusting a length of one of the connecting arms (moving amount control means) 25.

Figure 3:
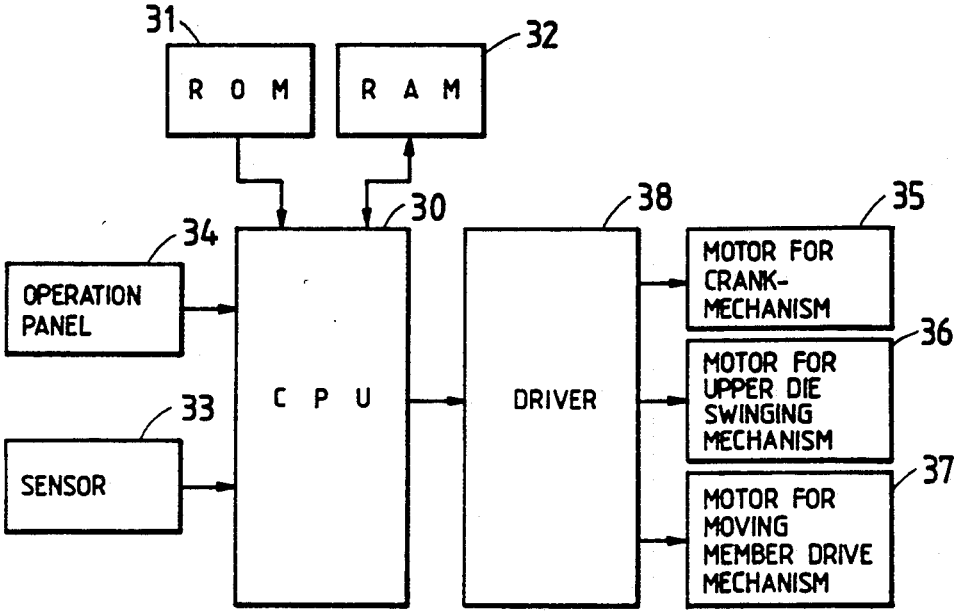
Figure 4:
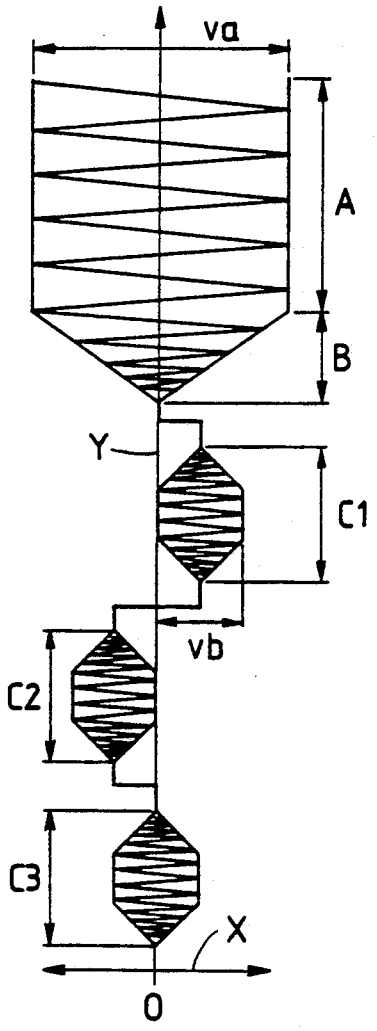

The plastic working apparatus according to this embodiment is provided with a control circuit shown in FIG. 3. The control circuit is provided with a central processing unit (CPU) 30, a program memory (ROM) 31 and a working memory (RAM) 32. As shown in FIG. 4, stored into the ROM 31 are various kinds of control modes for carrying out a desired plastic work while adjusting a relative vertical distance between the upper and lower dies 16 and 5, the swinging amplitudes Va and Vb of the upper die 16 and the displacement of the swinging center changeable by the relative positional displacement between the upper and lower dies in horizontal direction. Incidentally, in FIG. 4, the ordinate axis Y represents a vertical distance between the upper and lower dies 16 and 5, whereas the abscissa axis X represents the moving amount (amplitude) in the right and left directions of the upper die 16 relative to the lower die 5.

On the other hand, on the lower die support ram 4, there are provided sensors such as magnetic sensors (detector means) 33 (FIGS. 1 and 3) for detecting a vertical distance between the support ram 4 and the moving member 12. The sensor 33 is connected to the CPU 30 as shown in FIG. 3. The sensors 33 generate an output signal indicative of the vertical distance, and the signal is inputted into the CPU 30. Further, an operation panel 34 is electrically connected to the CPU 30, so that a mode selection signal is inputted into the CPU 30 on the basis of the key operation on the operation panel 34. Furthermore, a driver 38 is electrically connected between the CPU 30 and motors 35, 36 and 37. The crank mechanism 6, the upper die swinging mechanism 19 and the moving member driving mechanism 23 are provided, respectively, with these motors 35, 36 and 37 for drivingly rotating the drive shafts 7, 20 and 24. The CPU will output drive signals through the motor driver 38 so as to energize the respective motors 35 to 37.

In summary, the plastic working apparatus includes a swing amplitude control unit which includes a storing means for storing a plurality of swing amplitude modes, a selector means for selecting one of the plurality of swing amplitude modes; and, a controller means for controlling at least the amplitude control mechanism in response to said selected swing amplitude mode. The control unit further includes detection means for detecting distance between the dies and for outputting a signal indicative of said distance, and mode change means for changing the selected swinging amplitude to a new swing amplitude mode in response to the output signal.

With the thus constructed plastic working apparatus, under the condition that, as shown in FIG. 1, the workpiece W be laid on the lower die 5, the respective motors 35 to 37 are driven by the CPU 30 in accordance with the preselected single control mode, for example, the mode shown in FIG. 4, while monitoring the input signals from the magnetic sensors 33. Then, over a predetermined period A (FIG. 4) of the mode, the lower die 5 is gradually raised through the crank mechanism 6 and the lower die support ram 4, so that the vertical distance between the upper and lower dies 16 and 5 is shortened. At the same time, the upper die 16 is swung at a constant amplitude Va through the upper die moving mechanism 19 and the holder 18.

Thereafter, over a predetermined period B, the swing amplitude of the upper die 16 is gradually dampened while reducing the vertical distance between the upper and lower dies 16 and 5, and the swing motion of the upper die 16 is temporarily stopped at the final stage of the period B. Subsequently, after the swing center of the upper die 16 has been moved rightwardly relative to the lower die 5 through the moving member driving mechanism 23 and the moving member 12, the swing amplitude of the upper die 16 is gradually increased, and then the swing amplitude is kept constant Vb and thereafter gradually decreased in this order, while shortening the distance between the upper and lower dies 16 and 5 over a predetermined period C1.

Then, after the swing center of the upper die 16 has again been moved leftward through the moving member driving mechanism 23 and the moving member 12, the same operation as in the period C1 is carried out over a predetermined period C2. After the expiration of the period C2, the upper die 16 is again moved rightwardly until the swing center is brought to a position identical with that in the predetermined period A. Under this condition, the same operation as in the periods C1 and C2 is carried out over a predetermined period C3. As a result, the plastic working has been finished in which the machined product has a shape identical with the shaping face 17 of the upper die 16.

Such mode changes are selectively made in accordance with material and shape of the workpiece W and final targetting shape of the product. Further, such mode change can be achieved in response to the distance between the upper and lower dies which distance is detected by the detector 33. Furthermore, the plastic working can be terminated upon the distance between the upper and lower dies being less than a predetermined level. Upon completion of the plastic working, the upper and lower dies are relatively moved away from each other.

As has been described above, according to the first embodiment, the upper die 16 is swung at a predetermined amplitude, and in accordance with the swing motion, the workpiece W is depressed against the lower die 5. At the same time, the center of the swing amplitude relative to the workpiece W is changeable in the horizontal direction while the distance between the upper and lower dies is also changeable in the vertical direction. Therefore, fluidity of the plasticized metal of the workpiece is accelerated to thereby enhance the machining accuracy in coining, sizing or other types of forging.

Figure 5:
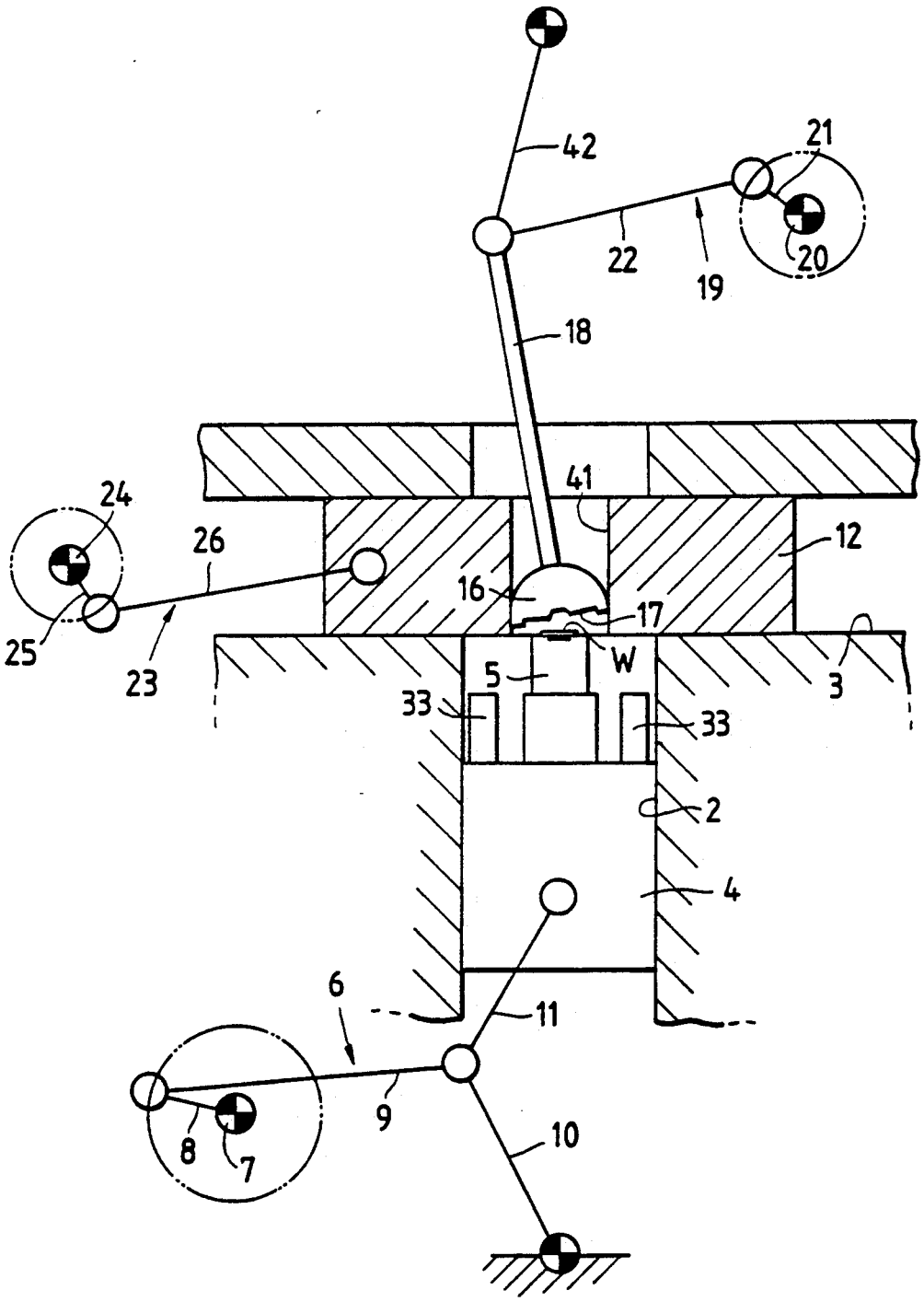
Figure 6A:
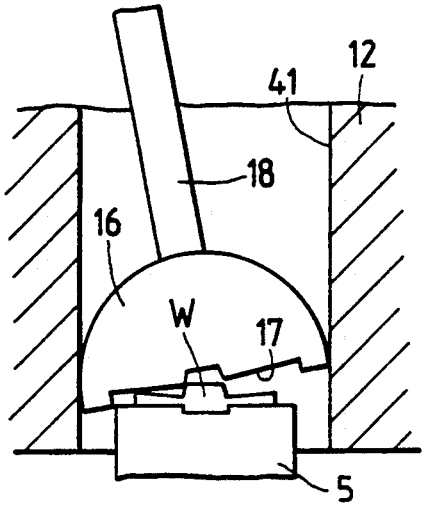
Figure 6B:
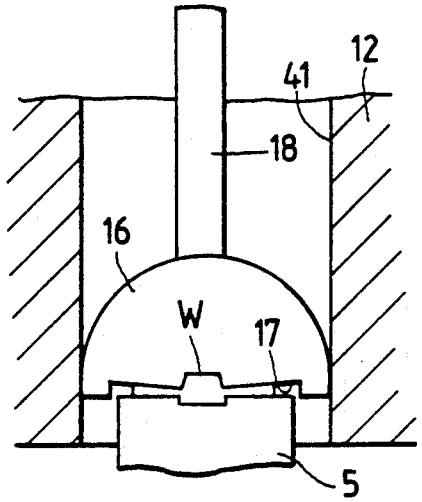
Figure 6C:
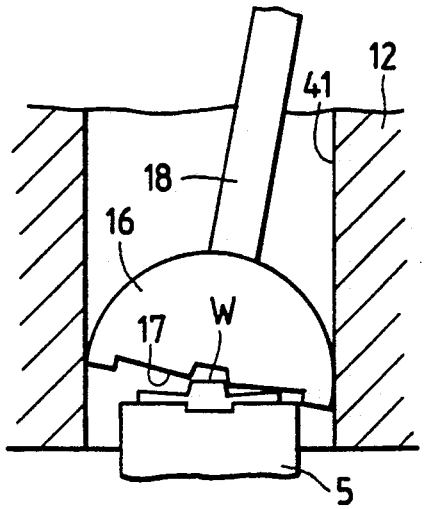

A second embodiment according to the invention will next be described with reference to FIGS. 5 and 6, wherein like parts and components are designated by the same reference numerals and characters as those shown in the first embodiment. In the following description, particularly described is the difference between the second and the first embodiments so as to clarify the structure of the second embodiment.

In the second embodiment, there is provided a guide hole 41 having a circular cross-section. The guide hole 41 completely extends through the moving member 12 in a vertical direction. The upper die 16 is positioned within the hole 41 and is provided vertically movable relative to the upstanding hole 41 and swingable within the guide hole 41.

A swing lever 42 is further provided to the upper die drive mechanism 19. The swing lever 42 has an upper end pivotally supported to a given stationary position and a lower end rotatably connected to the upper end of the holder 18. With the structure, the upper die 16 is swung while it is vertically reciprocally movable by the cooperation of the swing lever 42.

Accordingly, similar to the first embodiment, it is possible to swing the upper die 16 at a predetermined amplitude, and to move the center of the swing amplitude relative to the workpiece W. Therefore, it is possible to accelerate the plastic flow of the workpiece material to thereby enhance the machining accuracy. In addition, as shown in FIGS. 6(*a*) to 6(*c*), the upper die 16 is also vertically movable through the swing lever 42 in connection with the swing motion of the upper die 16. Therefore, when the swinging amplitude of the upper die 16 is dampened in accordance with the development of the plastic working, the upper die 16 is made closer to the lower die 5 in proportion to the amplitude. Therefore, it is possible to ensure the convergent operation of the upper die 16 relative to the workpiece W, so that it is possible to further enhance the machining accuracy.

Figure 7:
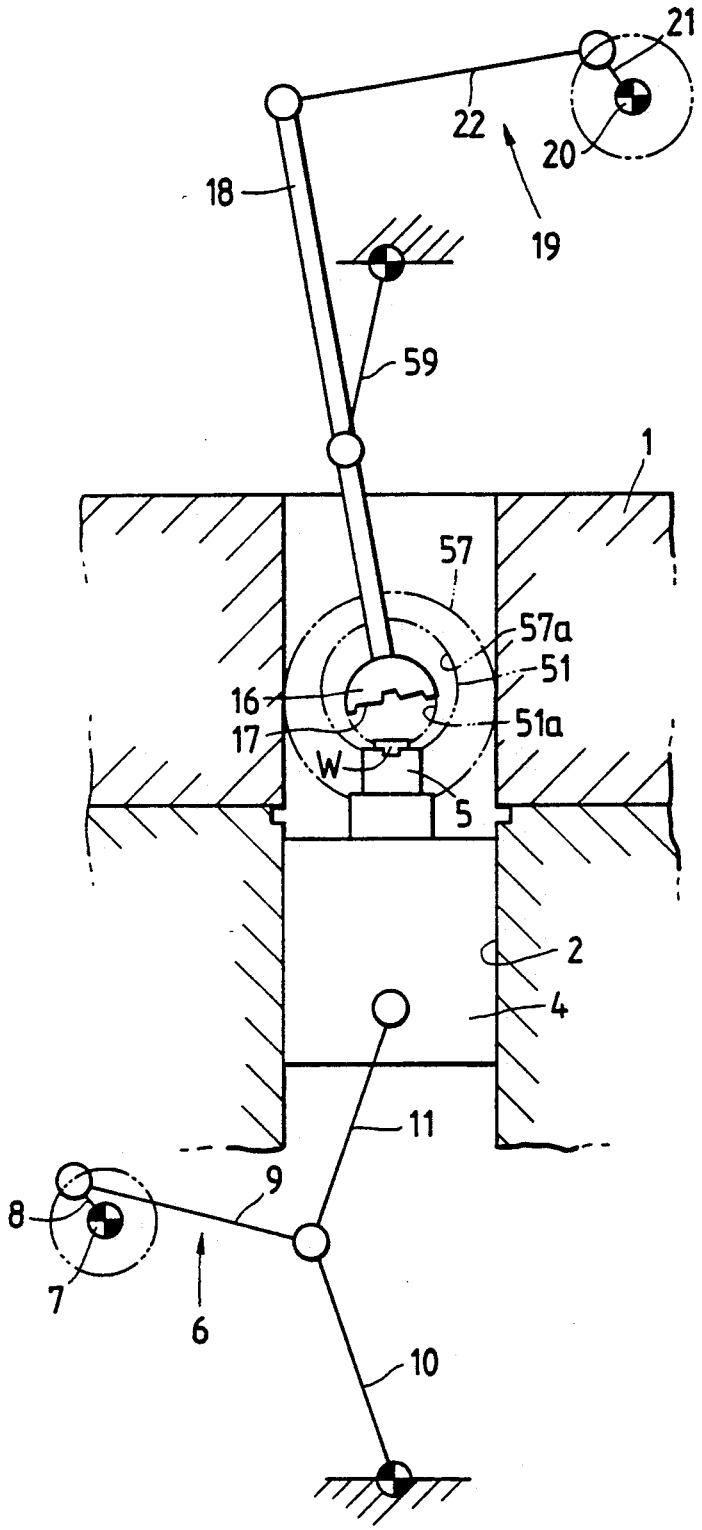
Figure 8:
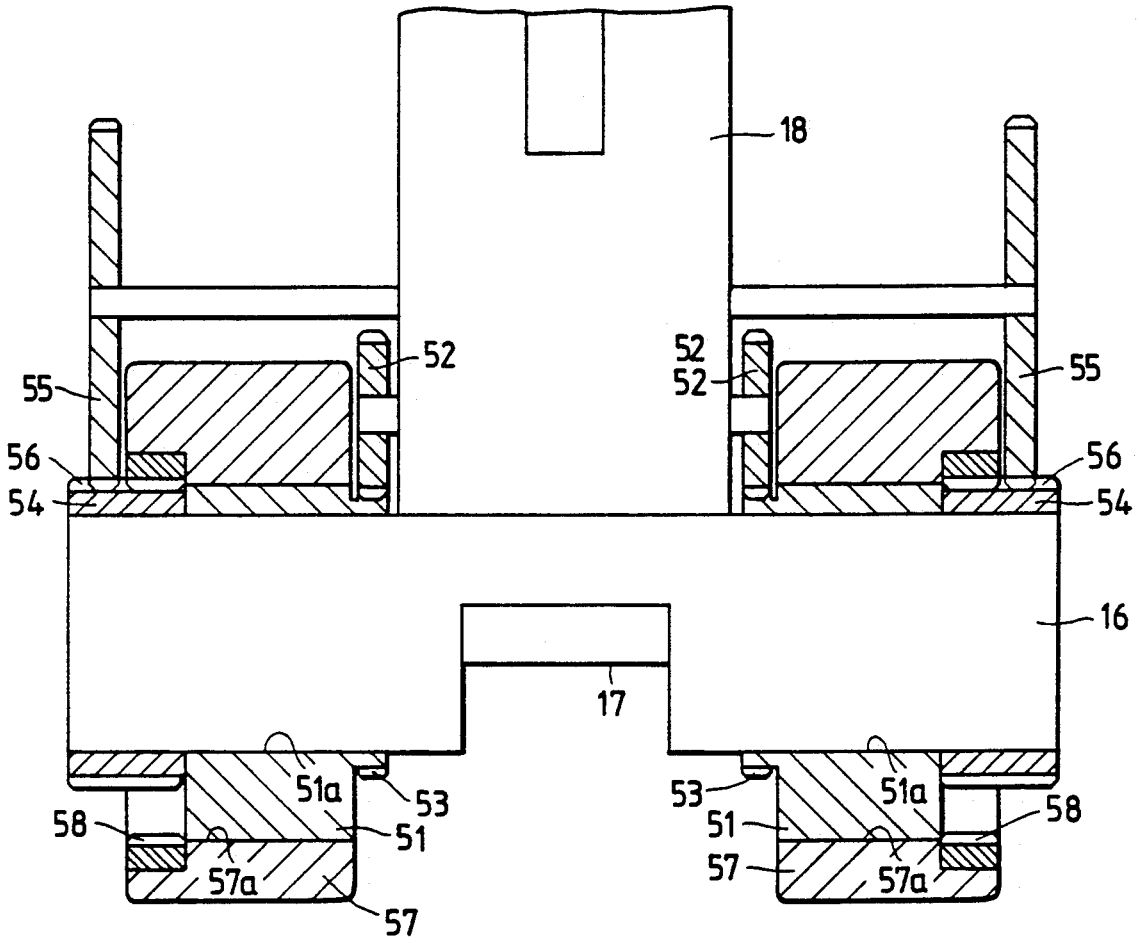

A third embodiment of the invention will be described with reference to FIGS. 7 thru 9 mainly as to the difference over the foregoing embodiments. As best shown in FIG. 8, in the third embodiment, inner rotary bodies 51 are mounted over both end portions of the upper die 16. The inner rotary bodies 51 are formed with eccentric bores 51*a* which are fitted with the end portions of the upper die 16 and are provided with gear portions 53 at axially inner portions thereof. Further, drive gears 52 having relatively small diameters are provided to the holder 18. The drive gears 52 are in meshing engagement with the gear portions 53 of the rotary bodies 51. In accordance with the rotation of small diameter drive gears 52, the inner rotary bodies 51 are rotated through the engagement between the drive gears 52 and driven gears 53.

Intermediate rotary bodies 54 are mounted over both ends of the upper die 16 and at positions outside of the respective inner rotary bodies 51. The intermediate rotary bodies 54 are provided with outer gear portions 56. Further, drive gears 55 having relatively large diameters are provided to the holder 18. The large diameter drive gears 55 are in meshing engagement with the outer gear portions 56 of the intermediate rotary bodies 54. In accordance with the rotation of large diameter drive gears 55, the intermediate rotary bodies 54 are rotated through the engagement of the drive gears 55 and intermediate gears 56.

Outer rotary bodies 57 are rotatably mounted over outer peripheral surfaces of the inner rotary bodies 51. The outer bodies 57 are formed with eccentric bores 57*a* with which the inner bodies 51 are fitted. Each of the outer bodies 57 has an axially outer portion provided with an internal gear 58 engageable with the outer gear portion 56 of the intermediate body 54. As shown in FIG. 7, outer peripheral surfaces of the outer rotary bodies 57 are movably engaged along an inner surface of the first guide hole 2 of the base frame 1. In accordance with the rotation of the intermediate rotary bodies 54, the outer rotary bodies 57 are rotated because of the meshing engagement between the gears 56 and 58. Furthermore, a swing lever 59 which is supported at its upper end is rotatably connected at its lower end to an intermediate portion of the holder 18.

Figure 9C:
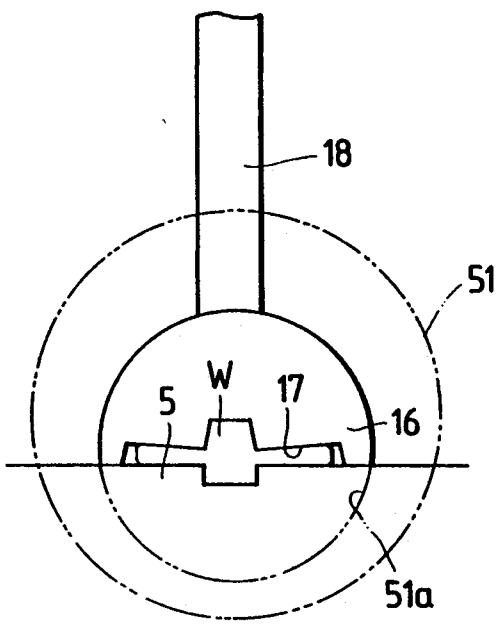
Figure 9B:
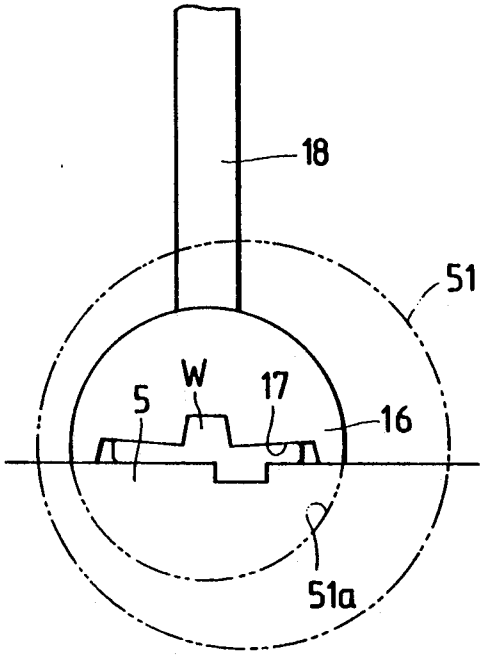
Figure 9A:
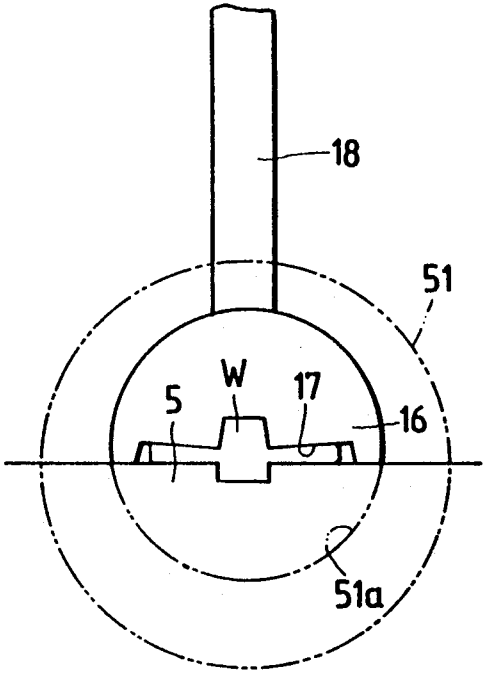

Accordingly, in the third embodiment, when the respective drive gears 52 and 55 are rotated by a pair of drive motors (not shown), the respective rotary bodies 51 and 57 are rotated, so that the relative position of the upper die 16 relative to the lower die 5 is changed in vertical and horizontal directions as shown in FIGS. 9(*a*) to 9(*c*). When the upper die swinging mechanism 19 is actuated under the condition that the relative position between the upper and lower dies 16 and 5 is provisionally determined, the upper die 16 is swung along the inner surface of the eccentric holes 51*a* of the inner rotary bodies 51 through the holder 18 and the swing lever 59.

Therefore, also in this embodiment, it is possible to accelerate the plastic flow of the workpiece material as in the foregoing embodiments, thus greatly enhancing the machining accuracy. Furthermore, since it is possible to move the upper die 16 in both vertical and horizontal directions by means of the pair of rotary bodies 51 and 57 each provided with the eccentric holes 51*a* and 57*a*, it is possible to set the swing center of the upper die 16 in a wide range as desired.

Incidentally, the present invention is not limited to the respective embodiments but it is possible to modify or change the respective parts or components within the spirit of the invention. For example, the lower die is stationarily arranged, and the upper die is moved in unison with the moving member toward and away from the lower die. Alternatively, the outer rotary bodies 57 in the third embodiment are dispensed with, and the inner rotary bodies 51 are directly engaged with the first guide hole 2. In the further alternative, the workpiece W is mounted rotatable about its axis on the lower die.

As has been described above, the load center is changeable relative to the workpiece during the plastic working operation, thereby accelerating the plastic flow of the material to thus ensure high machining accuracy.

A fourth embodiment according to this invention will next be described in detail with reference to FIGS. 10 thru 13. In the foregoing embodiments, the holders 18 are moved in two dimensional plane, and therefore, the movements of the holders are referred to as swinging movement. On the other hand, according to the fourth embodiment, the corresponding holder is movable in three dimensional space, and therefore, in the description below, this movement is referred to as swivelling movement. The fourth embodiment particularly concerns a forging machine in which a die system utilizes a pair of co-operating dies, one of which is adapted to perform a "circular" rocking motion relative to the other about a center at or near the axial center line of the dies. Further, the center line can be displaceable for providing a variety of operational modes similar to the first thru third embodiments.

Figure 10:
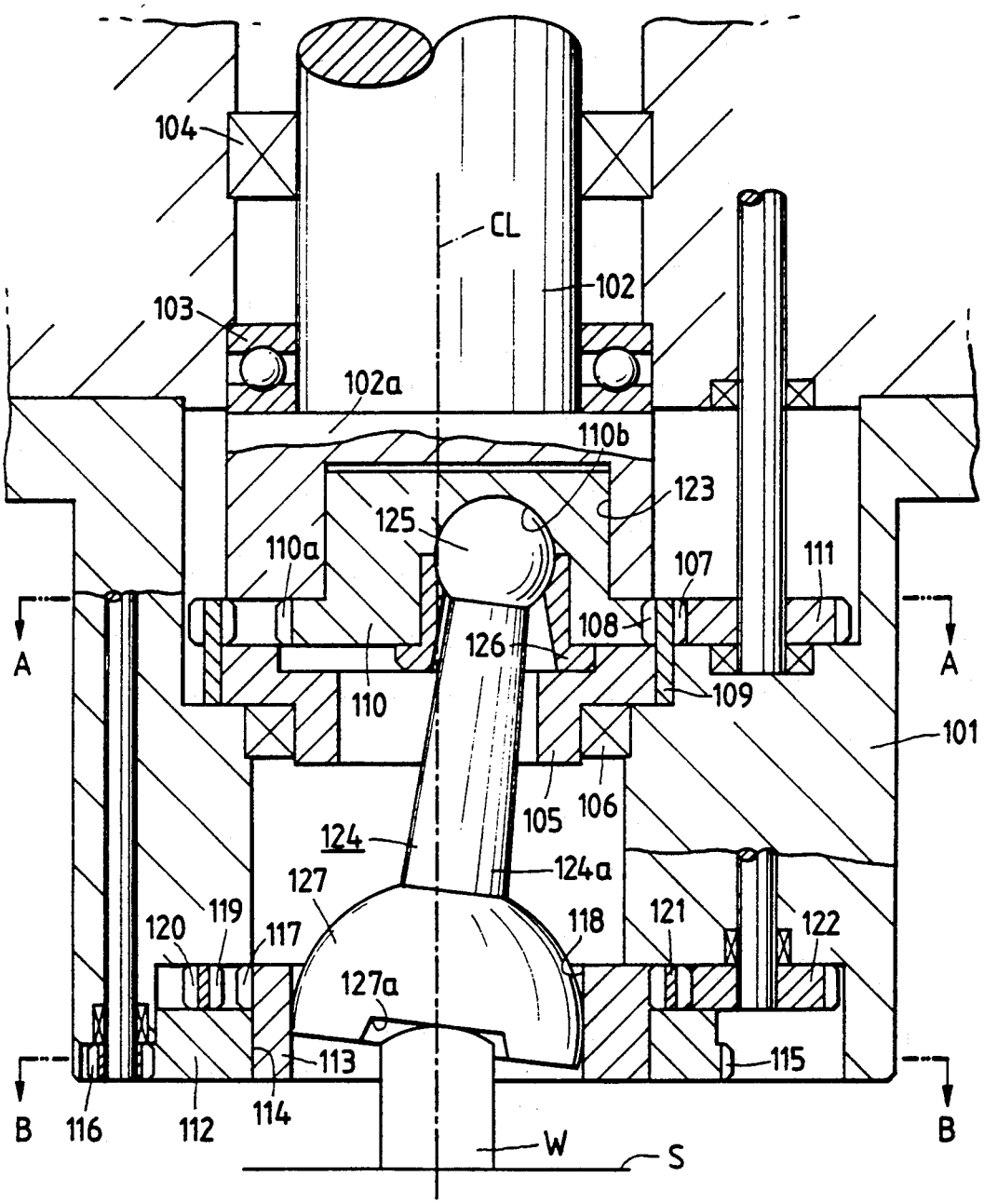
Figure 11:
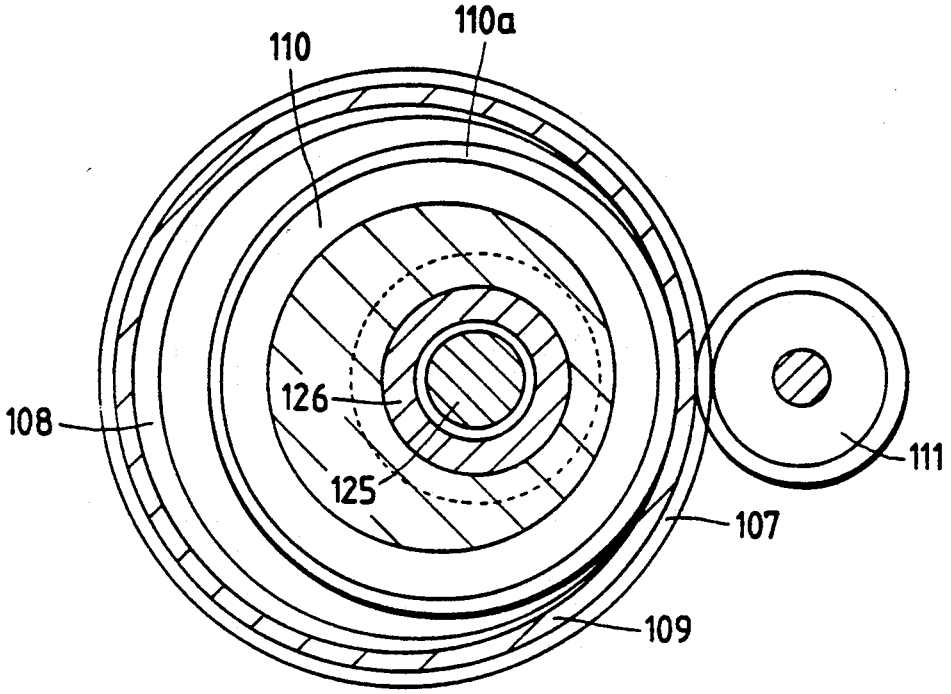

As shown in FIG. 10, a rotary shaft 102 is rotatably supported to bearings 103 and 104 within a base frame 101. The rotary shaft 102 is connected to a drive motor (not shown) for its rotation about its axis CL. The rotary shaft 102 has a large diameter portion 102*a* at its lower end portion. A workpiece support surface S is arranged below the base frame 101 so as to confront an end portion of a rotary shaft 102. The support surface S is directed in a direction perpendicular to the axis CL. The axis CL passes through centers of the upper and lower dies in their non-operative states. The support surface S corresponds to an upper surface of a lower die in the first thru third embodiments. A workpiece W is disposed on the support surface S. As shown in FIGS. 10 and 11, an annular rotary body 105 is rotatably supported to the base frame 101 by a bearing 106 so as to confront the end portion 102*a* of the rotary shaft 102 within the base frame 101. A ring gear 109 having outer teeth 107 and inner teeth 108 is mounted on an outer peripheral surface of the rotary body 105. A support member 110 is rotatably supported with a predetermined eccentricity relative to the axis CL of the rotary shaft 102 at the end portion 102*a* of the rotary shaft 102. That is, the end portion 102*a* is formed with an eccentrical recess 123 with which the supporting member 110 is rotatably fitted. The support recess 123 is formed with a predetermined eccentricity relative to a rotary axis of the support member 110 and to the central axis CL of the rotary shaft 102. A gear 110*a* formed on the support member 110 is engaged with the inner teeth 108 of the ring gear 109. Further, a first drive gear 111 connected to a drive motor (not shown) is provided at a position adjacent the ring gear 109, and is meshedly engaged with the outer teeth 107 of the ring gear 109. The support member 110 is rotated through the ring gear 109 in accordance with the rotation of the first drive gear 111.

Figure 12:
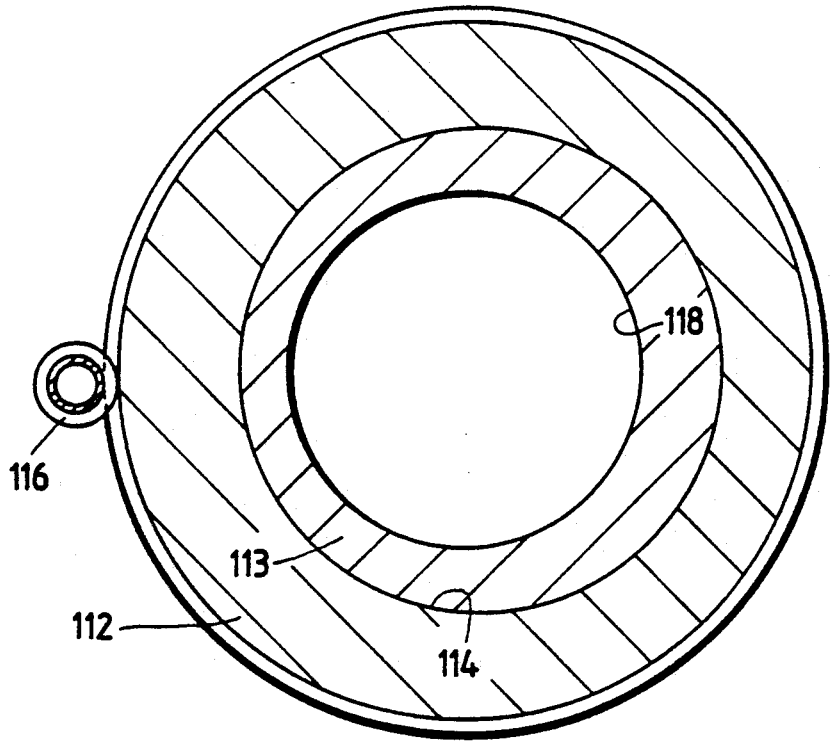
Figure 13A:
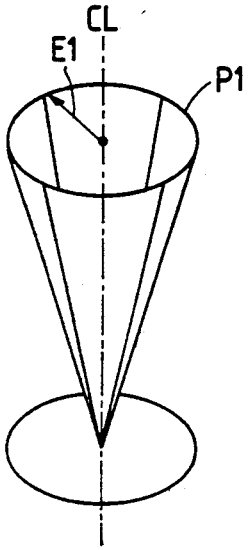
Figure 13B:
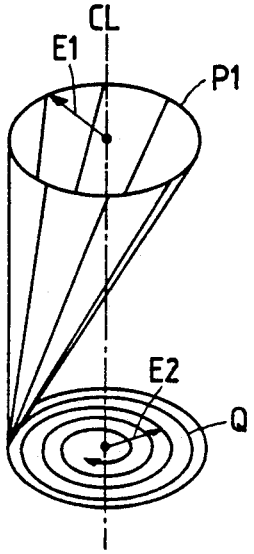
Figure 13C:
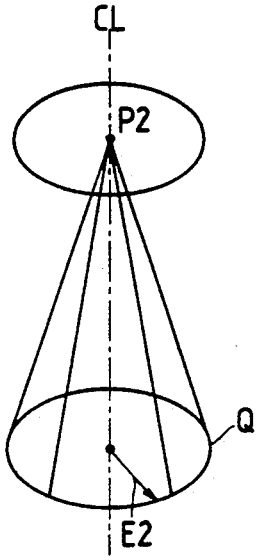
Figure 13D:
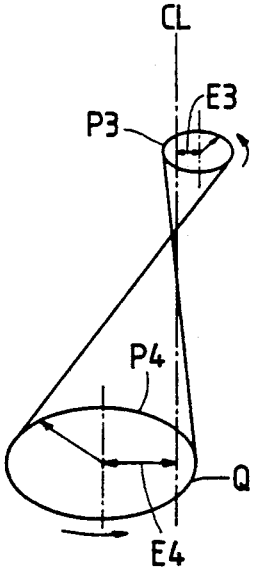
Figure 13E:
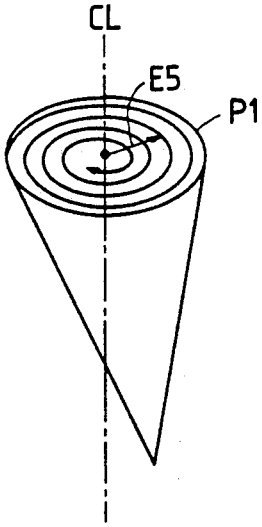
Figure 13F:
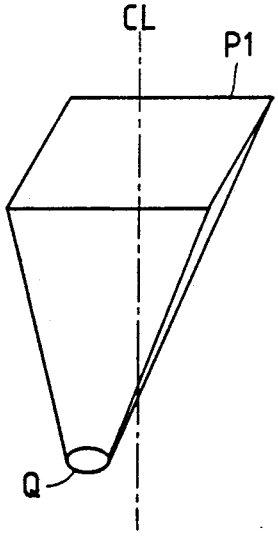

As shown in FIGS. 10 and 12, a pair of inner and outer eccentric rotary bodies 112 and 113 are rotatably supported on a lower edge of the base frame 101 so as to confront the end portion 102*a* of the rotary shaft 102. An eccentric hole 114 is formed in the outer eccentric rotary body 112 with an eccentricity relative to the axis CL of the rotary shaft 102 from its own rotary axis. At the same time, a transmission gear 115 is formed on an outer periphery of the outer eccentric rotary body 112. Further, a second drive gear 116 connected to a drive motor (not shown) is disposed at a position adjacent the outer eccentric rotary body 112 and is meshedly engaged with the gear teeth 115 of the rotary body 112. In accordance with the rotation of the second drive gear 116, the outer eccentric rotary body 112 is rotated.

The inner eccentric rotary body 113 is mounted in the eccentric hole 114 of the outer eccentric rotary body 112 for relative rotation. A transmission gear 117 is formed on an outer periphery of the inner eccentric rotary body 113. At the same time, an eccentric hole 118 is formed in the inner eccentric rotary body with an eccentricity relative to its own rotary axis. A ring gear 121 having inner and outer teeth 119 and 120 is arranged on the outer periphery of the inner eccentric rotary body 113, with the inner teeth 119 being engaged with the transmission gear 117 of the inner eccentric rotary body 113. Further, a third drive gear 122 connected to a drive motor (not shown) is disposed at a position adjacent the ring gear 121 and is meshedly engaged with the outer teeth 120 of the ring gear 121. Then, in accordance with the rotation of the third drive gear 22, the inner eccentric body 113 is rotated through the ring gear 121.

A holder 124 is interposed between the support member 110 and the inner eccentric rotary body 113 with its shaft portion 124*a* being oriented at a predetermined slant angle with respect to the axis CL of the rotary shaft 102. More specifically, a spherical connecting piece 125 formed at a proximal end of the holder 124 is rotatably received in a spherical recess 110*b* of the supporting member 110, and a ring-like support piece 126 is assembled over the shaft portion 124*a* for preventing the holder 124 from falling apart from the support member 110. A spherical die mounting portion 127 is formed integrally with a distal end of the holder 124 and is rotatably engaged with the eccentric hole 118 of the inner eccentric rotary body 113. The die mounting portion 127 is formed with a recess 127*a* at a substantially central portion of an end face thereof, and there is mounted a die having a molding hole (not shown) for effecting plastic working to a workpiece W.

With the thus constructed plastic working apparatus or forging apparatus, drive motors (not shown) for driving the rotary shaft 102 and the respective drive gears 111, 116 and 122 are controlledly energized, so that the forging work may be performed in accordance with respective operational modes exemplified in FIGS. 13(*a*) to 13(*f*). In the illustrated Figures, the top curve P1 or top point P2 indicate a locus and position of the spherical connecting piece 125 of the holder 124, and a bottom curve Q indicates a path of a point of the upper die which point comes into contact with the workpiece W.

For instance, in the case where the forging is carried out in accordance with the operational mode shown in FIG. 13(*a*), first of all, the first drive gear 111 is rotated so that the support member 110 is rotated through the ring gear 109 to render the eccentricity E1 of the spherical connecting piece 125 constant with respect to the axis CL. Also, the second and third gears 116 and 122 are rotated so as to rotate the inner and outer eccentric bodies 112 and 113, whereby the die on the die mounting portion 127 is arranged on the axis CL of the rotary shaft 102 and at the same time, is brought into contact with the workpiece W. When the rotary shaft 102 is rotated under the condition that the workpiece W is held in a predetermined position on the workpiece support surfaces S, the holder 124 is swivelled about the axis CL of the rotary shaft 102. Thus, the plastic working is applied to the workpiece W in accordance with a shape of the molding hole of the die.

On the other hand, in the case where the forging work is carried out in accordance with the operational mode shown in FIG. 13(*b*), the eccentricity E1 of the spherical connecting piece 125 of the holder 124 is set constant in the manner the same as the former case, and at the same time, the workpiece W is fixedly arranged on the workpiece support surface S. Under this condition, the rotary shaft 102 is rotated while the eccentricity E2, with respect to the axis CL, of the die is gradually reduced by adjusting and changing the angular positional relationship between the inner and outer eccentric rotary bodies 112 and 113. As a result, swivelling center of the die on the workpiece W is changed during forging to the workpiece. Such operation mode is particularly available for providing a roundish product such as a head of a rivet.

In the case where the forging work is carried out in accordance with the operational mode shown in FIG. 13(*c*), the spherical connecting piece 125 of the holder 124 is located on the axis CL of the rotary shaft 102, that is, on the point P2 so that the eccentricity is set at zero, and at the same time, the workpiece W is fixedly arranged on the workpiece support surface S. Furthermore, the rotary position of the inner eccentric rotary body 113 is adjusted to set a constant eccentricity E2 of the die. Thereafter, the second drive gear 116 is rotated to rotate the outer eccentric body 112.

Also the forging in accordance with the operational mode shown in FIG. 13(*d*) may be carried out as follows. The rotary shaft 102 and the inner eccentric rotary body 113 are rotated so that the spherical connecting piece 125 of the holder 124 and the die on the die mounting portion 127 are located with eccentricities E3 and E4 with respect to the axis CL, respectively. In this arrangement, under the condition that the rotations of the rotary shaft 102 and the inner eccentric rotary body 113 are stopped, the support member 110 is rotated by the first drive gear 111, and simultaneously therewith, the outer eccentric rotary shaft 112 is rotated by the second drive gear 116. As a result, circular locuses P3 and P4 are provided.

In the case where the forging is carried out in accordance with the operational mode shown in FIG. 13(*e*), the third drive gear 122 causes the inner eccentric rotary shaft 113 to rotate so that the die on the die mounting portion 127 is located at an eccentric position with respect to the axis CL. Under this condition, the rotary shaft 102 and the support member 110 are rotated while adjusting the rotational amounts of the rotary shaft 102 and the support member 110, so that the eccentricity E5 of the spherical connecting piece 125 of the holder is gradually reduced. In this case, the inner and outer eccentric bodies are not rotated any more.

The forging in accordance with the operational mode shown in FIG. 13(*f*) may be carried out as follows. Under the condition that the rotation of the outer eccentric rotary body 112 is suspended, the inner eccentric rotary body 113 is rotated. At the same time, the rotation of the rotary shaft 102 and the first drive gear 111 are controlled so that the spherical connecting piece 125 depicts the locus in the form of a rectangular shape centrally about the axis CL.

As described above, in the fourth embodiment, since the swivelling center of the die is changeable, it is possible to carry out the precision work with a high fluidity of the plasticized metal of the workpiece material, and to perform a variety of forging in accordance with the respective operational mode. Further, similar to the first thru third embodiments, it is apparent that various modifications can be effected to the fourth embodiment. For example, it is possible to dispense with the outer eccentric rotary body 112 or to move the workpiece during the working.

As has been described in detail, the present invention enjoys advantages such that, by changing the swinging or swivelling center of the die, load center with respect to the workpiece can be changed, so that it is possible to perform the high accuracy forging by providing high fluidity of the plasticized metal of the workpiece material, and also it is possible to perform various kinds of plastic workings by providing various operational modes, and therefore, a product having highly intricate configuration can be manufactured.

While the invention has been described in detail and with reference to specific embodiments thereof, it would be apparent for those skilled in the art that various changes and modifications can be made therein without departing from the spirit and scope of the invention.

What is claimed is:

1. In a plastic working apparatus including a frame, a first die having a shaping face, and a second die confronting the first die for mounting thereon a workpiece, the workpiece being depressed by co-operation of the first and second die, thereby applying a plastic work to the workpiece, the improvement comprising;

a die holder means having one end connected to the first die;

moving means for providing swivelling motion through an angle in three dimensional space to the die holder means for depressing the workpiece against the second die so that the first die moves against the workpiece in a compound motion;

guide means cooperating with said die holder for guiding vertical movement of the one end of the die holder, to thus enable vertical reciprocating motion of the first die; and changing means for changing said angle of the die holder means with respect to an imaginary axis which extends through the workpiece to provide a vertical reciprocating motion of the first die relative to said second die.

2. A method for plastic working in which a workpiece is depressed by co-operation of a first die and a second die, and the workpiece providing a position through which an imaginary axis extends, the method comprising the steps of:

swivelling the first die in three dimensional space at an angle with respect to the imaginary axis for depressing the workpiece on the second die so that the first die moves against the workpiece in a compound motion; and changing the angle, thereby reciprocally moving said first die along the imaginary axis with respect to said second die to thereby plastic work said workpiece between the two dies.

3. A method for plastic working in which a workpiece is depressed by co-operation of a first die and a second die, and the workpiece providing a position through which an imaginary axis extends, the method comprising the steps of:

swinging the first die at an angle with respect to the imaginary axis for depressing the workpiece on the second die so that the first die moves against the workpiece in a compound motion; and changing the angle, thereby reciprocally moving said first die along the imaginary axis with respect to said second die to thereby plastic work said workpiece between the two dies.

* * * * *